US008619103B2

(12) United States Patent
White et al.

(10) Patent No.: US 8,619,103 B2
(45) Date of Patent: Dec. 31, 2013

(54) ELECTROLUMINESCENT DEVICE MULTILEVEL-DRIVE CHROMATICITY-SHIFT COMPENSATION

(75) Inventors: Christopher J. White, Avon, NY (US); John W. Hamer, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 249 days.

(21) Appl. No.: 13/017,657

(22) Filed: Jan. 31, 2011

(65) Prior Publication Data

US 2012/0194565 A1 Aug. 2, 2012

(51) Int. Cl.
*G09G 5/10* (2006.01)

(52) U.S. Cl.
USPC ..... 345/690

(58) Field of Classification Search
USPC ..... 345/690, 55, 77
See application file for complete search history.

(56) References Cited

U.S. PATENT DOCUMENTS

| | | | | |
|---|---|---|---|---|
| 4,769,292 | A | 9/1988 | Tang et al. | |
| 5,061,569 | A | 10/1991 | VanSlyke et al. | |
| 5,929,843 | A | 7/1999 | Tanioka | |
| 6,329,764 | B1 | 12/2001 | Van De Ven | |
| 6,453,067 | B1 | 9/2002 | Morgan et al. | |
| 6,879,098 | B2 | 4/2005 | Buchwalter et al. | |
| 6,885,380 | B1 | 4/2005 | Primerano et al. | |
| 6,897,876 | B2 | 5/2005 | Murdoch et al. | |
| 7,557,367 | B2 | 7/2009 | Rogers et al. | |
| 7,622,367 | B1 | 11/2009 | Nuzzo et al. | |
| 2005/0168564 | A1 * | 8/2005 | Kawaguchi et al. | 347/237 |
| 2006/0114200 | A1 * | 6/2006 | Yamashita et al. | 345/77 |
| 2006/0262053 | A1 | 11/2006 | Lee et al. | |
| 2007/0032089 | A1 | 2/2007 | Nuzzo et al. | |
| 2007/0057263 | A1 | 3/2007 | Kahen | |
| 2008/0185971 | A1 | 8/2008 | Kinoshita | |
| 2008/0252797 | A1 | 10/2008 | Hamer et al. | |
| 2009/0189530 | A1 | 7/2009 | Ashdown et al. | |
| 2009/0199960 | A1 | 8/2009 | Nuzzo et al. | |
| 2010/0123268 | A1 | 5/2010 | Menard | |
| 2010/0123694 | A1 | 5/2010 | Cok et al. | |
| 2010/0148683 | A1 | 6/2010 | Zimmermann et al. | |
| 2011/0273102 | A1 * | 11/2011 | van de Ven et al. | 315/193 |

OTHER PUBLICATIONS

Lee, "TFT-LCD with RGBW Color System", SID 03 Digest, 40.5LB/-w. Lee, 40.5L: Late-News Paper, pp. 1212-1215, Copyright 2003.

Broadcast Monitor Buyer's Guide, Library maintained by Chan, Glenn "Understanding Black Level" http://www.glennchan.info/broadcast-monitors/understanding/black-level.htm Jun. 23, 2009 archive.

* cited by examiner

*Primary Examiner* — William Boddie
*Assistant Examiner* — Leonid Shapiro
(74) *Attorney, Agent, or Firm* — Global OLED Technology LLC

(57) ABSTRACT

Compensation for chromaticity shift of an electroluminescent (EL) emitter having a luminance and a chromaticity that both correspond to current density is performed. Different black, first and second current densities are selected based on a received designated luminance and a selected chromaticity, each current density corresponding to emitted light colorimetrically distinct from the light emitted at the other two current densities. Respective percentages of a selected emission time are calculated for each current density to produce the designated luminance and selected chromaticity. The current densities are provided to the EL emitter for the calculated respective percentages of the emission time so that the integrated light output of the EL emitter during the selected emission time is colorimetrically indistinct from the designated luminance and selected chromaticity.

16 Claims, 9 Drawing Sheets

ELECTROLUMINESCENT DEVICE MULTILEVEL-DRIVE CHROMATICITY-SHIFT COMPENSATION

CROSS REFERENCE TO RELATED APPLICATION

Reference is made to commonly-assigned, co-pending U.S. patent application Ser. No. 12/191,478, filed Aug. 14, 2008, entitled "OLED device with embedded chip driving" by Winters et al. and published as US 2010-0039030, to commonly-assigned, co-pending U.S. patent application Ser. No. 12/272,222, filed Nov. 17, 2008, entitled "Compensated drive signal for electroluminescent display" by Hamer et al. and published as US 2010-0123649, and to commonly-assigned, co-filed U.S. patent application Ser. No. 13/017,749, entitled "Electroluminescent device aging compensation with multilevel drive" by White, the disclosures of which are incorporated by reference herein.

FIELD OF THE INVENTION

The present invention relates to solid-state electroluminescent (EL) devices such as organic light-emitting diode (OLED) displays, and particularly to compensation for chromaticity shift of emitters in such devices.

BACKGROUND OF THE INVENTION

Additive color digital image display devices are well known and are based upon a variety of technologies such as cathode ray tubes, liquid crystal modulators, and solid-state light emitters such as Organic Light Emitting Diodes (OLEDs). Devices such as solid-state lamps are also being produced. In a common additive color display device, a pixel includes red, green, and blue colored subpixels. These subpixels correspond to color primaries that define a color gamut. By additively combining the illumination from each of these three subpixels, i.e. with the integrative capabilities of the human visual system, a wide variety of colors can be achieved. In one technology, OLEDs can be used to produce color directly using organic materials that are doped to emit energy in desired portions of the electromagnetic spectrum, or alternatively, broadband emitting (apparently white) OLEDs can be attenuated with color filters to achieve red, green and blue.

It is possible to employ a white, or nearly white, subpixel along with the red, green, and blue subpixels to improve power efficiency or luminance stability over time. Other possibilities for improving power efficiency or luminance stability include the use of one or more additional non-white subpixels, such as yellow subpixels. However, images and other data destined for display on a color display device are typically stored or transmitted in three channels, that is, having three signals corresponding to a standard (e.g., sRGB) or specific (e.g., measured CRT phosphors) set of primaries. Therefore incoming image data will have to be converted for use on a display having four subpixels per pixel rather than the three subpixels used in a three channel display device.

In the field of CMYK printing, conversions known as undercolor removal or gray component replacement are made from RGB to CMYK, or more specifically from CMY to CMYK. At their most basic, these conversions subtract some fraction of the CMY values and add that amount to the K value. These methods are complicated by image structure limitations because they typically involve non-continuous tone systems, but because the white of a subtractive CMYK image is determined by the substrate on which it is printed, these methods remain relatively simple with respect to color processing. Attempting to apply analogous algorithms in continuous tone additive color systems would cause color errors if the additional primary is different in color from the display system white point.

In the field of sequential-field color projection systems, it is known to use a white primary in combination with red, green, and blue primaries. White is projected to augment the brightness provided by the red, green, and blue primaries, inherently reducing the color saturation of some or all of the colors being projected. A method proposed by Morgan et al. in U.S. Pat. No. 6,453,067 teaches an approach to calculating the intensity of the white primary dependent on the minimum of the red, green, and blue intensities, and subsequently calculating modified red, green, and blue intensities via scaling. However, the scaling cannot restore, for all colors, all of the color saturation lost in the addition of white. The lack of a subtraction step in this method ensures color errors in at least some colors. Additionally, Morgan's disclosure describes a problem that arises if the white primary is different in color from the desired white point of a display device, but does not adequately solve the problem. The method simply accepts an average effective white point, which effectively limits the choice of white primary color to a narrow range around the white point of the device.

A similar approach is described by Lee et al. ("TFT-LCD with RGBW Color System", *SID* 03 *Digest*, pp. 1212-1215) to drive a color liquid crystal display having red, green, blue, and white pixels. Lee et al. calculate the white signal as the minimum of the red, green, and blue signals, then scale the red, green, and blue signals to correct some, but not all, color errors, with the goal of luminance enhancement paramount. The method of Lee et al. suffers from a similar color inaccuracy to that of Morgan.

In the field of ferroelectric liquid crystal displays, another method is presented by Tanioka in U.S. Pat. No. 5,929,843. Tanioka's method follows an algorithm analogous to the familiar CMYK approach, assigning the minimum of the R, G, and B signals to the W signal and subtracting the same from each of the R, G, and B signals. To avoid spatial artifacts, the method teaches a variable scale factor applied to the minimum signal which results in smoother colors at low luminance levels. Because of its similarity to the CMYK algorithm, it suffers from the same problem cited above, namely that a white pixel having a color different from that of the display white point will cause color errors.

Primerano et al., in U.S. Pat. No. 6,885,380, and Murdoch et al., in commonly-assigned U.S. Pat. No. 6,897,876, the disclosures of both of which are incorporated by reference herein, describe methods for transforming three color-input signals (R,G,B) into four color-output signals (R,G,B,W) which do not cause color errors when the white pixel has a color different from that of the display white point. Although useful, these methods assume that the color of the emitters and in particular the color of the W emitter (white, in these cases) is constant.

As described by Lee et al. in US 2006/0262053, the color of a white-emitting OLED can change with the controlling voltage. In other words, the color of a white-emitting OLED can vary with the intensity of emission. This problem can affect white subpixels in OLED or EL displays. It can also affect OLED or EL lamps, which can be considered to include a single, very large white subpixel. While a number of other methods have addressed the problem of transforming three color-input signals to four color-output signals, e.g., Morgan et al. in U.S. Pat. No. 6,453,067, Choi et al. in US 2004/

0222999, Inoue et al. in US 2005/0285828, van Mourik et al. in WO 2006/077554, Chang et al. in US 2006/0187155, and Baek in US 2006/0256054, these methods cannot adjust for a white emitter with variable color. While Lee's method can adjust for a white emitter with variable color, it requires a set of six coefficients to apply a correction after the conversion from three color signals to four color signals. This method is computationally and memory intensive, and would be slow and difficult to implement in a large display. Gathering data for the method requires manual adjustments that can be time-consuming and labor-intensive. It requires gathering spectral data, which is more complex and time-consuming than colorimetric measurements. Further, it does not mathematically provide a colorimetric match between a desired RGB color and the RGBW equivalent.

Co-pending commonly-assigned U.S. Patent Application Publication No. 2008/0252797, filed Apr. 13, 2007, entitled "Method for input-signal transformation for RGBW displays" by Hamer et al., the disclosures of which are incorporated by reference herein, describes a method for transforming RGB to RGBW, where the W has color that varies with drive level.

US Patent Application Publication No. 2009/0189530 by Ashdown et al. describes feedback control of RGB LEDs by superimposing AM modulation on the PWM drive signal. However, the AM modulation does not provide control of chromaticity or luminance. It serves only to differentiate the R, G and B channels when sensed by a single photosensor.

US Patent Application Publication No. 2008/0185971 by Kinoshita describes adjusting current density and duty cycle of an EL emitter independently to vary chromaticity while keeping luminance constant. However, this scheme is limited to only chromaticities the EL emitter can produce natively. This is not sufficient for full-color displays, in which the desired chromaticity may not lie on the chromaticity locus of the EL emitter.

There is a need, therefore, for an improved method for compensating for chromaticity shift of an EL emitter in a single- or multi-color EL device or display.

SUMMARY OF THE INVENTION

According to one aspect of the present invention, there is provided a method for compensating for chromaticity shift of an electroluminescent (EL) emitter, comprising:

a) providing the EL emitter for receiving current and emitting light having a luminance and a chromaticity that both correspond to the density of the current;

b) providing a drive circuit electrically connected to the EL emitter for providing the current to the EL emitter;

c) receiving a designated luminance and selecting a chromaticity for the EL emitter;

d) selecting different black, first and second current densities based on the designated luminance and selected chromaticity, wherein i) at the selected black, first and second current densities the emitted light has respective, black, first and second luminances and respective, black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

e) calculating respective black, first and second percentages of a selected emission time using the designated luminance, the selected chromaticity, and the black, first and second luminances and chromaticities, wherein the sum of the black, first and second percentages is less than or equal to 100%; and f) providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and selected chromaticity, respectively, whereby the chromaticity shift of the EL emitter is compensated.

According to another aspect of the present invention, there is provided a method for compensating for chromaticity shift of an electroluminescent (EL) emitter, comprising:

a) providing the EL emitter for receiving current and emitting light having a luminance and a chromaticity that both correspond to the density of the current;

b) providing a drive circuit electrically connected to the EL emitter for providing the current to the EL emitter;

c) receiving a designated luminance and selecting a chromaticity for the EL emitter;

d) selecting different black, first, second and third current densities based on the designated luminance and selected chromaticity, wherein i) at the selected black, first, second and third current densities the emitted light has respective, black, first, second and third luminances and respective, black, first, second and third chromaticities;

ii) the respective luminance of each of the black, first, second and third current densities is colorimetrically distinct from the other three luminances, or the respective chromaticity of each of the black, first, second and third current densities is colorimetrically distinct from the other three chromaticities; and iii) the black luminance is less than a selected threshold of visibility, and the first, second and third luminances are greater than or equal to the selected threshold of visibility;

e) calculating respective black, first, second and third percentages of a selected emission time using the designated luminance, the selected chromaticity, and the black, first, second and third luminances and chromaticities, wherein the sum of the black, first, second and third percentages is less than or equal to 100%; and f) providing the black, first, second and third percentages to the drive circuit to cause it to provide the black, first, second and third current densities to the EL emitter for the black, first, second and third percentages, respectively, of the selected emission time, so that the integrated light output of the EL emitter during the selected emission time has an output luminance and output chromaticity colorimetrically indistinct from the designated luminance and selected chromaticity, respectively, whereby the chromaticity shift of the EL emitter is compensated.

According to another aspect of the present invention, there is provided a method for compensating for chromaticity shift of an electroluminescent (EL) emitter, comprising:

a) providing a display substrate having a device side;

b) providing the EL emitter for receiving current and emitting light having a luminance and a chromaticity that both correspond to the density of the current, wherein the EL emitter is disposed over the device side of the display substrate;

c) providing an integrated circuit chiplet having a chiplet substrate different from and independent of the display substrate, wherein the chiplet includes a drive circuit electrically connected to the EL emitter for providing the current to the EL emitter, and the chiplet is located over, and affixed to, the device side of the display substrate;

d) receiving a designated luminance and selecting a chromaticity for the EL emitter;

e) selecting different black, first and second current densities based on the designated luminance and selected chromaticity, wherein i) at the selected black, first and second current densities the emitted light has respective, black, first and second luminances and respective, black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

f) calculating respective black, first and second percentages of a selected emission time using the designated luminance, the selected chromaticity, and the black, first and second luminances and chromaticities, wherein the sum of the black, first and second percentages is less than or equal to 100%; and g) providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and selected chromaticity, respectively, whereby the chromaticity shift of the EL emitter is compensated.

An advantage of this invention is an EL device that compensates for chromaticity shift of the organic materials in the device without requiring extensive lookup tables. A further advantage of this invention is that it can provide chromaticity-shift compensation for EL devices that have only a single color of EL emitter, such as EL lamps. It is an important feature of this invention that it makes productive use of changes in chromaticity with current density which have hitherto been considered undesirable. It permits the adjustment of luminance independently of chromaticity. In some embodiments, it can use lower bit depth than conventional digital drive schemes. It advantageously permits the reproduction of colors that lie off the chromaticity locus of a particular EL emitter.

DETAILED DESCRIPTION OF THE INVENTION

Figure 9:
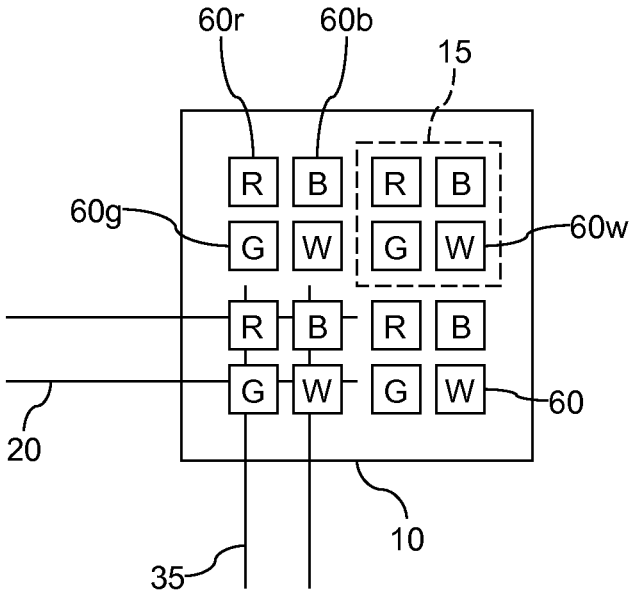
FIG. 9 is a plan view of an EL display according to an embodiment

FIG. 9 shows a plan view of an EL display 10 according to an embodiment. EL display 10 has an array of a plurality of EL subpixels 60 arranged in rows and columns and emitting various colors. Subpixels 60*r* emit substantially red light, subpixels 60*g* emit green, subpixels 60*b* emit blue, and subpixels 60*w* emit broadband light, such as yellow or white. "Broadband light" means light with a broader spectral bandwidth than red, green or blue, e.g., light with a full width at half maximum (FWHM) larger than the FWHM of red, green or blue. Adjacent RGBW subpixels 60*r*, 60*g*, 60*b*, 60*w* together compose a pixel 15.

Figure 7:
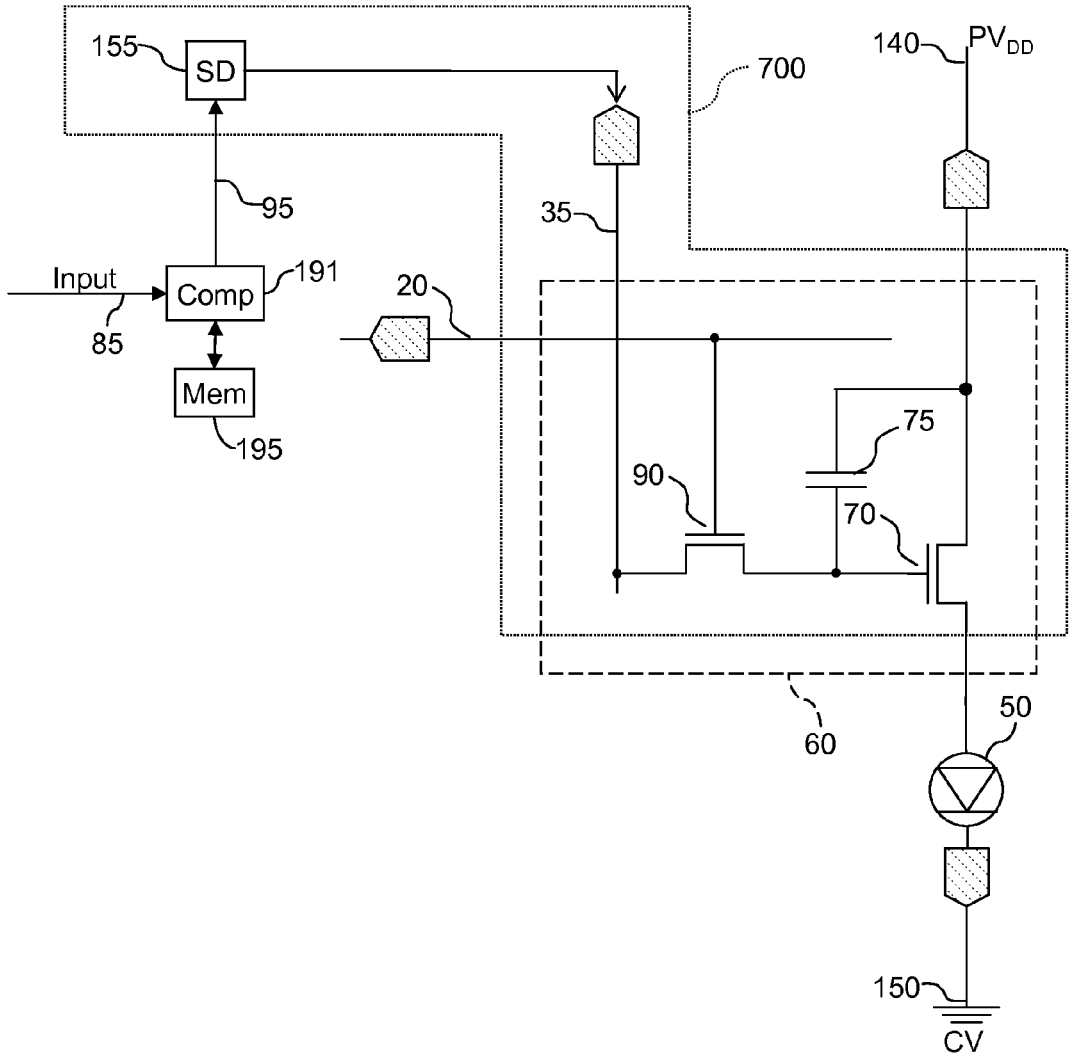
FIG. 7 is a schematic diagram of one embodiment of an EL subpixel and associated circuitry useful with various embodiments.

EL display 10 includes a plurality of row select lines 20; each row of EL subpixels 60 has a corresponding select line 20. EL display 10 further includes a plurality of data lines 35 where each column of EL subpixels 60 has an associated data line 35 for readout. Each subpixel 60 includes an EL emitter 50 (FIG. 7). Each subpixel is connected to a respective one of the data lines 35, and to a respective one of the select lines 20 (for clarity, not all of these connections are shown in FIG. 9). Note that the terms "row" and "column" do not require any particular orientation of the EL display 10.

Figure 1A:
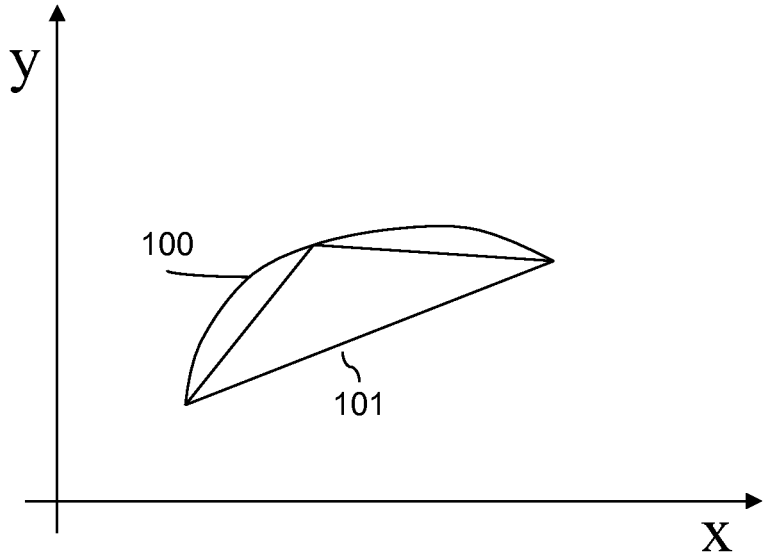
FIG. 1A is an exemplary chromaticity diagram showing characteristics of an EL emitter.

FIG. 1A shows an exemplary CIE 1931 x-y chromaticity diagram showing characteristics of an EL emitter 50 (FIG. 7). EL emitter 50 can be embodied in an EL device such as an EL display 10 or EL lamp. The EL emitter 50 receives current and emits light having a luminance (denoted Y in FIG. 1B) and chromaticity (x, y) that both correspond to the density of the current (J) through the EL emitter 50. Curve 100 shows the chromaticities of EL emitter 50 as current density changes. EL emitter 50 is preferably a broadband emitter such as a yellow or white emitter. The direction of increasing current density on curves 100, 130 (FIGS. 1A, 1B, 2A, 2B) is shown by the arrows thereon.

Three different current densities on each curve can be used to form a gamut analogous to a typical RGB color gamut. Gamut 101 uses three current densities from curve 100. Any chromaticity within gamut 101 can be reproduced by EL emitter 50.

Figure 1B:
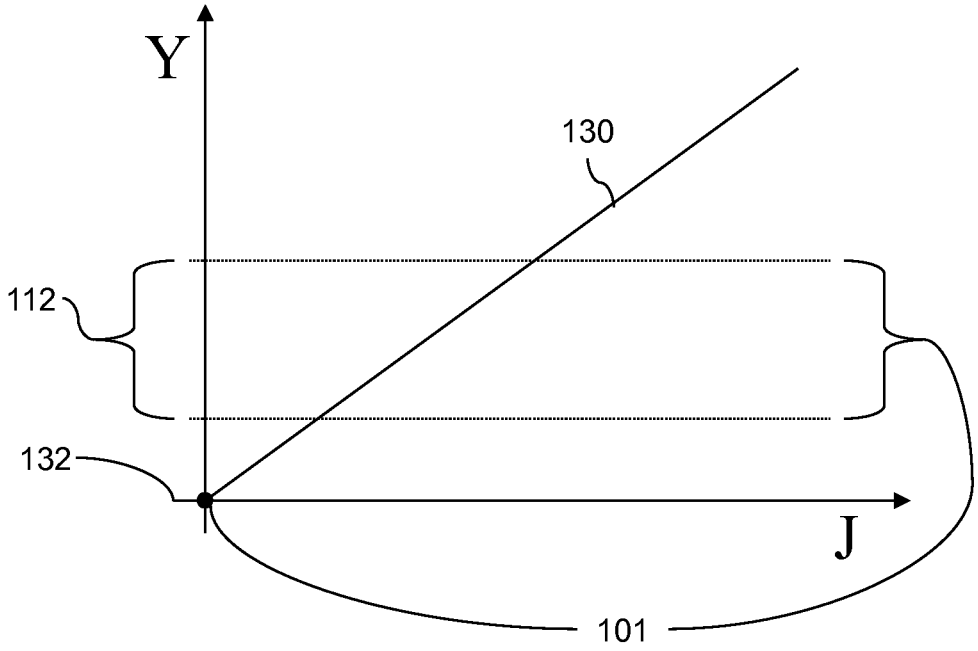
FIG. 1B is an exemplary chromaticity diagram showing characteristics of an EL emitter.

FIG. 1B is an exemplary plot showing, on curve 130, the luminance of an EL emitter 50 as a function of current density. Gamuts 101 can be unlike conventional RGB gamuts in that the luminances of the three primaries can be very different from each other. In such a situation, the luminances that can be reproduced in gamut 101 do not necessarily extend continuously down to black, but do generally include the black luminance. As shown here, gamut 101 includes a black luminance 132 and a luminance range 112 that does not include the black luminance. In some embodiments, gamut 101 does span continuously from black up to a selected peak luminance. On the ordinate is shown the luminance range 112 of gamut 110. The luminance range 112 of gamut 101 is the range between luminance of the highest and lowest colors reproducible in that gamut, not including the black luminance 132 (which is always reproducible in any gamut by setting all three primaries to produce as little light as possible, preferably totaling ≤0.05 nits). Colors within gamut 101 in both luminance and chromaticity can be reproduced using only EL emitter 50, as will be described below. The more luminance chromaticity variation EL emitter 50 undergoes as current density changes, the larger gamut 101 can be.

Figure 2A:
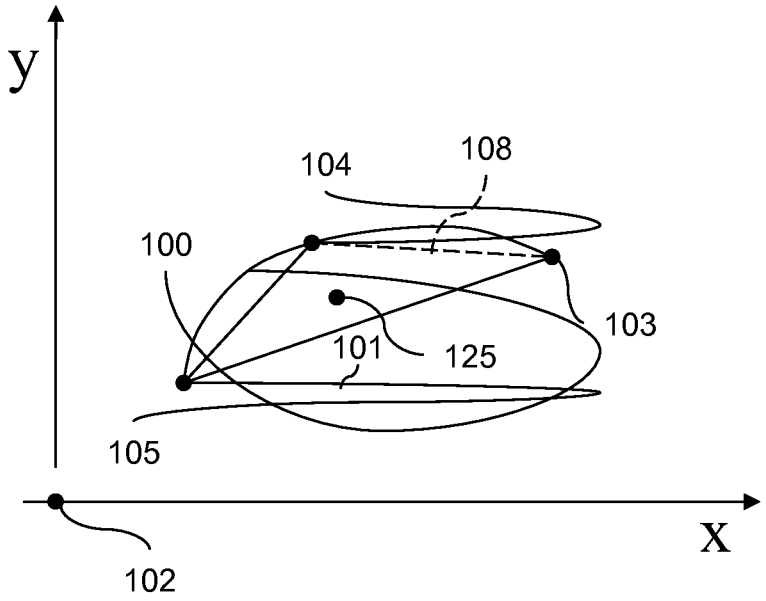
FIG. 2A is an exemplary chromaticity diagram showing primaries of a single EL emitter.
Figure 2B:
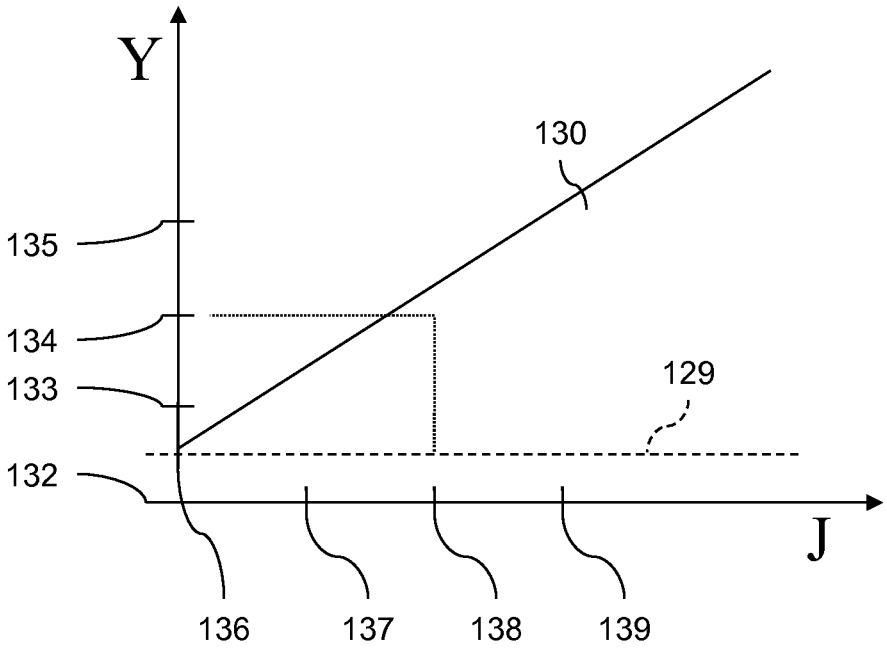
FIG. 2B is an exemplary luminance plot showing primaries of a single EL emitter.

FIG. 2A is a chromaticity (x,y) diagram, and FIG. 2B a current-density-to-luminance plot, showing specific points on curve 130 which form the primaries of gamut 101. Points are shown for selected black 136, first 137, second 138 and third 139 current densities. The current densities are selected based on a designated luminance and selected chromaticity for EL emitter 50, as will be described further below. When EL emitter 50 is driven with a current having black current density 136, the emitted light has chromaticities at black chromaticity 102 (FIG. 2A) and black luminance 132 (FIG. 2B). Note that "chromaticity" refers here to the chromaticity coordinates x and y considered together. At first current density 137, the emitted light is at first chromaticity 103 and first luminance 133. At second current density 138, the emitted light is at second chromaticity 104 and second luminance 134. At third current density 139, the emitted light is at third chromaticity 105 and third luminance 135. In this example, the black point is shown at Y=0 and (x,y)=(0,0), but that is not required. In some display systems, the black level has a luminance greater than 0, e.g., 0.05 nits, and therefore also non-zero chromaticities.

In some embodiments, only the black, first and second current densities are used. For example, line 108 (FIG. 2A) shows the points in chromaticity space producible using first current density 137 and second current density 138. That line plus black chromaticity 102 (black current density 136) define a gamut (indicated by the dotted lines to black chromaticity 102), albeit a narrow and limited-luminance one, producible using three current densities. In other embodiments, the black, first, second and third current densities are used and the entirety of gamut 101 is producible.

Hereinafter the term "primary" refers to the luminance (e.g., 132) and chromaticity (e.g., 102) produced at a particular current density (e.g., 136). For example, the "first primary" refers to the first luminance 133 and first chromaticity 103 produced by the EL emitter 50 when driven with current at first current density 137. The black point of the display at black current density 136 is referred to as the "black primary." This corresponds to the conventional meaning of "primary" in the art, but expands the definition to permit using multiple current densities of the same EL emitter 50 as different primaries, rather than only using different EL emitters as different primaries. Expressions such as "the luminances of the primaries" refer to the respective luminances of the black, first, second and, in some embodiments, third primaries, i.e. the respective luminances produced by EL emitter 50 at the black, first, second and optionally third current densities.

Each primary is different from the other primaries in either its luminance or chromaticity. That is, no two primaries produce exactly the same luminance and chromaticity. This provides a color gamut. Some primaries can have the same chromaticities but different luminances, some can have the same luminances but different chromaticities, and some can have different luminances and chromaticities. Specifically, the respective luminance (132, 133, 134, 135) of each of the black 136, first 137, second 138 and third 139 current densities is colorimetrically distinct from the other luminances, or the respective chromaticity (102, 103, 104, 105) of each of the black 136, first 137, second 138 and third 139 current densities is colorimetrically distinct from the other chromaticities. In embodiments with only the black, first and second current densities, each of the three chromaticities is colorimetrically distinct from the other two or each of the three luminances is distinct from the other two. In embodiments with the black, first, second and third current densities, each of the four chromaticities is colorimetrically distinct from the other three, or each of the four luminances is colorimetrically distinct from the other three.

"Different" and "colorimetrically-distinct" primaries are those separated visually, i.e. those that are at least 1 just-noticeable-difference (JND) apart. For example, the primaries can be plotted on the 1976 CIELAB L* scale, and any two primaries separated by at least 1 ΔE* are colorimetrically distinct. Distinct chromaticities can also be measured on the CIE 1976 u'v' diagram as those points with Δ(u', v')≥0.004478 (the MacAdam JND, cited on pg. 1512 of Raymond L. Lee, "Mie Theory, Airy Theory, and the Natural Rainbow," Appl. Opt. 37(9), 1506-1519 (1998), the disclosure of which is incorporated by reference herein), where Δ(u', v') is the Euclidian distance between two points on the CIE 1976 u'v' diagram. Other methods of determining whether two colors or primaries are colorimetrically distinct are well-known in the color science art.

The black luminance 132 is less than a selected threshold of visibility 129, and the first 133, second 134 and third 135 luminances are greater than or equal to the selected threshold of visibility 129. The threshold of visibility 129 is selected based on the limits of the human visual system. For example, the threshold of visibility 129 can be 0.06 nits or 0.5 nits. The threshold of visibility 129 can be selected based on display peak luminance, display dynamic range, and display characteristics (e.g., ambient contrast ratio and surface treatment). The black luminance 132 is less than the threshold of visibility 129 so that the mathematical treatment of gamuts described herein corresponds to the mathematical treatment of conventional RGB gamuts. When using a standard primary matrix or phosphor matrix ("pmat"), intensities of 0 add no luminance or chromaticity to what the user perceives. In various embodiments, intensities of 0 in this treatment can correspond to black current density 136. Since black luminance 132 is less than threshold of visibility 129, black luminance 132 and black chromaticity 102 add no perceptible brightness or color to what the user perceives, so intensities of 0 behave as expected. To provide a black luminance 132 below threshold of visibility 129, black current density 136 can be less than a selected threshold current density (not shown), e.g., 0.02 mA/cm$^2$.

To produce a color using gamut 101, a designated luminance is received and a chromaticity for the EL emitter 50 is selected. In one embodiment, the chromaticity is selected before mass-production of devices begins, and a device receives a sequence of designated luminances corresponding to the emission desired from different EL emitters 50 on the device. Designated luminances, hereinafter denoted "$Y_{W5}$" can be calculated from input RGB code values as known in the art, for example as shown in the above-referenced U.S.

Pat. No. 6,885,380 and U.S. Pat. No. 6,897,876. For example, when an (R, G, B) code value triple is received, $Y_W$ can be set equal to the minimum of the luminances corresponding to the R, G and B code values. An emission time 308 (FIG. 3A), e.g., a frame time such as 16⅔ ms (1/60 s), is selected.

Respective black, first, second and, in some embodiments, third percentages of the selected emission time 308 are calculated using the designated luminance, the selected chromaticity, and the black, first, second and optionally third luminances and chromaticities. The sum of the black, first, second and optionally third percentages is less than or equal to 100%. The calculated percentages are the intensities [0,1] of the respective primaries. The intensities sum to ≤1 (the percentages to ≤100%) because only one EL emitter 50 is being used, and therefore time-division multiplexing is used. In some embodiments with only the black, first and second primaries, the black, first and second percentages can sum to 100%. In some embodiments also using the third primary, the black, first, second and third percentages can sum to 100%.

The black, first, second and optionally third percentages are provided to the drive circuit 700 (FIGS. 6-8) to cause it to provide the black, first, second and optionally third current densities to the EL emitter 50 for the black, first, second and optionally third percentages, respectively, of the selected emission time 308, so that the integrated light output of the EL emitter 50 during the selected emission time 308 has an output luminance and output chromaticity colorimetrically indistinct, i.e. <1 JND, from the designated luminance and selected chromaticity, respectively, thus compensating for the chromaticity shift of the EL emitter 50. As described above, in some embodiments, only the black, first and second current densities, and no others, are provided by the drive circuit 700. In other embodiments, only the black, first, second and third current densities, and no others, are provided by the drive circuit 700.

Once the black 136, first 137, second 138 and optionally third 139 current densities of the primaries are selected based on the designated luminance and selected chromaticity (described below), the corresponding luminances and chromaticities of the primaries are used to calculate the percentages of the primaries to be used to produce the designated luminance and selected chromaticity. In embodiments which do not use the third current density 139, a virtual third primary is used to make a three-primary system. The virtual third primary can be selected having chromaticities which do not lay on the line between the first chromaticity 103 and second chromaticity 104, extended to infinity in both directions. The luminance of the virtual third primary can be selected arbitrarily. For example, the chromaticity of point 125 and the third luminance 135 can be selected as the virtual third primary.

A primary matrix ("pmat") is formed using the first, second and third luminances and chromaticities. The primaries' luminances and chromaticities are transformed into the primaries' XYZ tristimulus values (e.g., using the inverse of CIE 15:2004, 3rd. ed., ISBN 3-901-906-33-9, pg. 15, Eq. 7.3) as in Eq. 1:

$$X_p = x_p Y_p / y_p;\ Z_p = (1 - x_p - y_p) Y_p / y_p \qquad \text{(Eq. 1)}$$

where p=1, 2 or 3 for the first, second or third primary respectively. If the third current density 139 is not being used, the virtual third primary is employed for $x_3$, $y_3$, $Y_3$. The XYZ tristimulus values of the three primaries are then formed into a pmat according to Eq. 2:

$$pmat = \begin{bmatrix} X_1 & X_2 & X_3 \\ Y_1 & Y_2 & Y_2 \\ Z_1 & Z_2 & Z_3 \end{bmatrix} \qquad \text{(Eq. 2)}$$

Unlike conventional RGB-gamut systems, this pmat has no white point and no normalization. The tristimulus values produced by intensities of (1,0,0), (0,1,0), or (0,0,1) are simply those corresponding to the primaries' luminances and chromaticities, not to scaled versions of the luminances. Conventional pmats are described by W. T. Hartmann and T. E. Madden in "Prediction of display colorimetry from digital video signals", J. Imaging Tech, 13, 103-108, 1987, the disclosures of which are incorporated by reference herein.

Designated tristimulus values are then calculated from the designated luminance and chromaticity using Eq. 1, above, to produce $X_d$, $Y_d$, $Z_d$. Intensities for the three primaries are then calculated using Eq. 3:

$$\begin{bmatrix} I_1 \\ I_2 \\ I_3 \end{bmatrix} = pmat^{-1} \times \begin{bmatrix} X_d \\ Y_d \\ Z_d \end{bmatrix} \qquad \text{(Eq. 3)}$$

As in conventional systems, any intensity $I_p$ outside of the range [0, 1] is not reproducible. In embodiments without the third current density 139, any substantially non-zero value of $I_3$ (e.g., outside of [−0.01, 0.01]) indicates a non-reproducible color, since the virtual third primary is being used. Note that the intensities $I_p$ of the three primaries are of the three primaries of EL emitter 50, as discussed above, not intensities of R, G and B emitters on the EL device.

$I_1$, $I_2$ and $I_3$ are, respectively, the first, second and third percentages which are provided to the drive circuit 700. The EL emitter 50 is driven to emit light at the first, second and optionally third current density for the percentage of the emission time $t_f$ 308 specified by the respective $I_p$. $\Sigma I_p$ does not have to be 1 (100%); if it is less than 1, the black current density can be provided for the remainder $t_r$ of the emission time 308, or a time less than $t_r$, with $t_r$ being calculated according to Eq. 4:

$$t_r = t_f - \Sigma I_p. \qquad \text{(Eq. 4)}$$

In this way, a designated color is produced using the black 136, first 137, second 138 and optionally third 139 current densities selected based on the measured age of EL emitter 50. Consequently, various designated luminances can be produced at the selected chromaticity using different selected primaries. This permits compensation for the chromaticity shift of the EL emitter 50 with current density. The primaries can be selected using a lookup table which maps the designated luminance of EL emitter 50, and optionally the selected chromaticity, to the selected black 136, first 137, second 138 and optionally third 139 current densities. The EL device can include different lookup tables for different selected chromaticities, in which case each table maps designated luminance to the selected current densities. In various embodiments, more than three primaries are used. The pmat is extended to 3×4 or wider, and other transformations, such as white replacement, are used to calculate $I_p$. An example of such a technique useful with various embodiments is given in U.S. Pat. No. 6,885,380, referenced above.

Figure 3A:
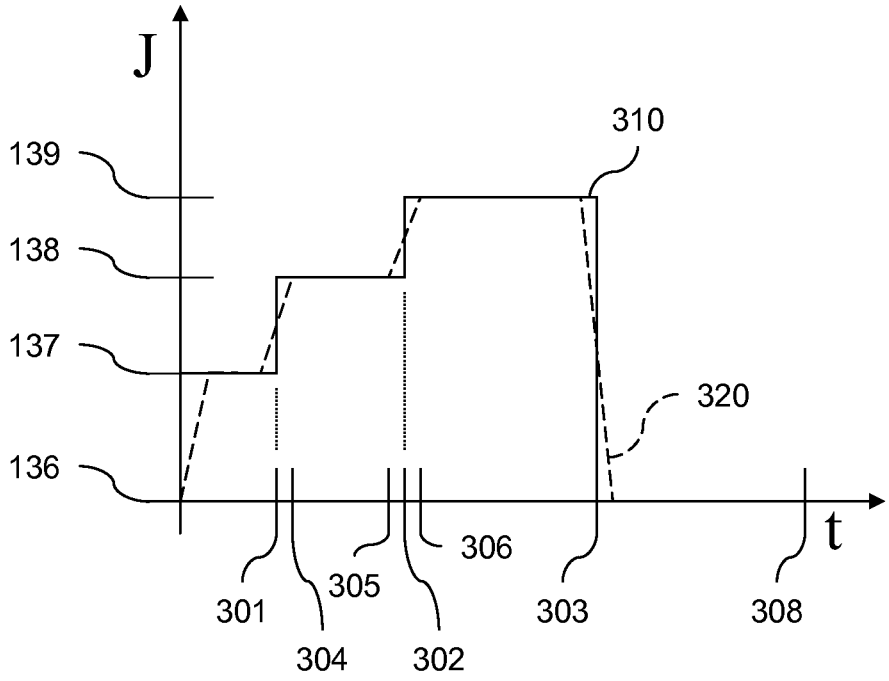
FIG. 3A is a plot of drive waveforms according to various embodiments.

Referring to FIG. 3A, various drive waveforms can be used to provide the primaries' current densities to EL emitter 50 for the corresponding percentages of the emission time 308. The abscissa shows time for a given emission period, $[0, t_p)$; the ordinate shows current density, e.g., in $mA/cm^2$.

Solid-line waveform 310 is a drive waveform using three primaries plus black. At the beginning of the emission time 308, the first current density 137 is provided. At time 301, the second current density 138 is provided. At time 302, the third current density 139 is provided. At time 303, the black current density 136 is provided. Here $\Sigma I_p<1$, and specifically $\Sigma I_p$ equals time 303. In some embodiments, waveforms such as waveform 310 provide a desired color with a lower bit depth than would be required for conventional digital drive, as different non-zero luminances can be combined to produce the desired color, rather than producing the color using entirely a single luminance. For example, low-luminance colors require very high bit depths in digital drive systems, because a very high luminance is emitted for a very short time. The short times are small fractions of the emission time, but require large numbers of bits to represent them. In various embodiments, a lower luminance is emitted for a longer time that is a larger fraction of the emission time and so requires fewer bits (one-half requires one bit, one-fourth two bits, one-eighth three bits and so on, so increasing the minimum time slice from one-eighth to one-fourth saves one bit).

Dashed-line waveform 320 shows a drive waveform like waveform 310, except with ramps between current densities. The $I_p$ values for waveform 320 are the times that the current density being provided to the EL emitter 50 is substantially steady (e.g., within ±5%) of the corresponding selected current density. For example, $I_2$ on waveform 320 is equal to time 305 minus time 304. $I_2$ for waveform 310, however, is equal to time 302 minus time 301. Here the black current density 136 is provided for a time less than $t_r$ of Eq. 4, because some of the emission time is occupied by ramps, e.g., from time 305 to time 306. Specifically, the sum of the black, first and second percentages is less than 100%, and the drive circuit 700 provides current ramps between consecutive current densities to the EL emitter 50. The ramps can be linear, quadratic, logarithmic, exponential, sinusoidal, or other shapes. The actual currents of the ramps can vary ±10% from ideal values. Sinusoidal ramps are sections of a sinusoid, e.g., $\sin(\theta)$ for $\theta$ on $[-\pi/2, \pi/2]$ scaled to fit between the current density levels. For example, the current density J(t) of a sinusoidal ramp from second current density 138 ($J_2$) to third current density 139 ($J_3$) from time 305 ($t_{305}$) to time 306 ($t_{306}$) centered on time 302 ($t_{302}$) can be calculated using Eq. 5:

$$J(t) = \frac{(J_3 - J_2)}{2}\sin\left(\frac{\pi}{t_{306} - t_{305}}(t - t_{302})\right) + \frac{(J_3 - J_2)}{2} \quad \text{(Eq. 5)}$$

Ramps, especially sinusoidal ramps, provide smoother transitions between current densities, reducing inductive kick as the current density changes. In an embodiment, no direct control of the ramp is provided. In between one current density and another, there is a transition period including an exponential ramp as capacitive loads charge under a constant applied voltage. In another embodiment, the transition period includes a linear ramp as capacitive loads charge under a constant applied current.

Figure 3B:
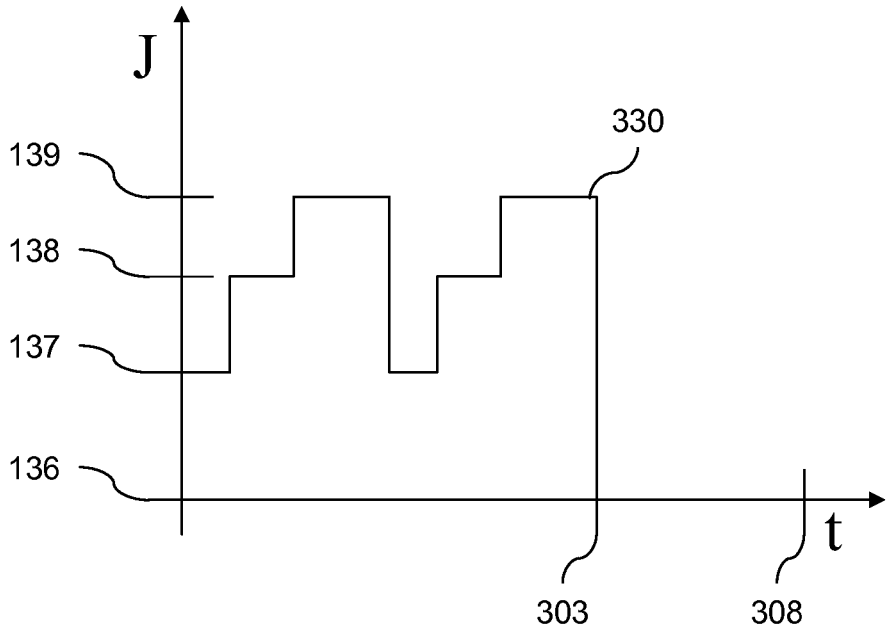
FIG. 3B is a plot of drive waveforms according to various embodiments.

FIG. 3B shows an alternative waveform 330. Waveforms 310 and 320 provide each of the black 136, first 137, second 138 and third 139 current densities for respective uninterrupted periods of time (or black, first and second current densities in embodiments where the third current density 139 is not used). Waveform 330, however, divides each current density's time period $I_p$ into multiple segments, e.g., into two segments. The total times $I_p$ are the same as waveform 310 (and their sum is still time 303), but each is divided in half, and the halves are separated in time. This can reduce the occurrence of dynamic false contouring as a viewer's eye moves over a display, and can reduce flicker. In this case, each of the black, first, second and optionally third current densities are provided for multiple respective separate segments of time in the emission time 308.

In some embodiments, luminance range 112 (FIG. 1B) does not include the full range of designated luminances to which the device should respond correctly. Outside of luminance range 112, a variety of waveforms can be employed. For example, standard DC operation or PWM operation at a selected current density can be employed, as known in the art, to provide the designated luminance at the chromaticity on curve 100 closest to the selected chromaticity, or another chromaticity. Alternatively, two (instead of three) primaries can be used, permitting selection of primaries at different luminances that can be employed when using all three primaries.

The different black, first, second and optionally third current densities are selected based on the designated luminance and selected chromaticity (hereinafter "$xyY_d$"). One way to do this is to characterize an EL emitter 50 before mass-production. Based on measurements of the luminance and chromaticity of the W emitter at various current densities, appropriate primaries can be selected for each $xyY_d$. However, given limitations typically placed on the resolution (i.e. driver bit depths) of current densities and intensities, it is not always possible to reproduce exactly the selected chromaticity at a particular designated luminance (e.g., point 125 of FIG. 2A). As described above, it is sufficient that the integrated light output of the EL emitter 50 during the selected emission time 308 have an output luminance and output chromaticity colorimetrically indistinct from, although not identical to, the designated luminance and selected chromaticity, respectively. In one example, point 125 corresponds to $I_p$=[0.5, 0.4, 0.75]. In a two-bit system, 0.4 is not an available intensity; only 0, 0.25, 0.5, 0.75 and 1.0 are available. However, if the difference between the tristimulus values corresponding to $I_p$=[0.5, 0.4, 0.75] and to $I_p'$=[0.5, 0.5, 0.75] (0.4 forced to the reproducible intensity 0.5) is less than one JND, the reproduction $I_p'$ is colorimetrically indistinct from the desired reproduction $I_p$, and so is acceptable to a user of the EL device. The bit depths of intensities and current densities should be considered along with the luminances and chromaticities of the EL emitter 50 at various current densities to select the appropriate primaries for each age. 1-D or 2-D lookup tables can be used.

The different black 136, first 137, second 138 and optionally third 139 current densities based on the measured age of EL emitter 50 can be selected as follows. The luminances and chromaticities of any number of points are received, those points being measured along a current density sweep of EL emitter 50 at any number of ages. The number of combinations of these points is determined by the resolution with which current densities can be supplied to EL emitter 50. For example, there are sixteen possible combinations of current densities available for two, two-bit current supplies. A set of test intensities to try is also selected. The number of test intensities is determined by the resolution of intensities, i.e. how finely the emission time 308 can be subdivided. Respective test tristimulus values are calculated for the test intensities for each possible pmat. Test CIELAB values are then calculated from the test tristimulus values.

A set of aim designated luminances is then selected. For each aim designated luminance, the CIELAB ΔE* is computed between the entire test CIELAB values and the aim designated luminance at the selected chromaticity. The intensity combination having the lowest ΔE* is selected as the intensity for that aim designated luminance, and the ΔE* is recorded. The ΔE* in the selection can be weighted, e.g., to weight luminance error more heavily than chromaticity error, or vice versa. Additionally, any test CIELAB value (and corresponding test intensities) having ΔE*>1 JND (e.g., >1.0 or >2.0) can be omitted from consideration, as the result would not be colorimetrically indistinct from the desired luminance at the selected chromaticity. Alternatively or additionally, the test intensities corresponding to any test tristimulus value that are not within 1 JND u'v' of the selected chromaticity can be omitted. The recorded ΔE* values for the (non-omitted) test intensities of a particular combination of current densities are combined, e.g., by taking the mean and maximum ΔE*. The combination with desired ΔE* characteristics for the test intensities is then selected as the set of primaries to use. For example, the combination with the lowest max(ΔE*) or rms (ΔE*) can be selected.

This method will select a single black, first, second and optionally third primary current density to be used for designated luminances. Alternatively, different primaries can be selected for different designated luminances or ranges of designated luminances. The selection can be performed at manufacturing time and stored in the EL device (e.g., EL display 10), or performed during operation of the EL device.

Selected primaries were calculated from measured data of a representative OLED emitter. This example was calculated with three-bit intensities and approximately four-bit current densities. The producible luminance range for this example is approximately 0 nits to 10,840 nits. The chromaticity locus passes through the measured points given in Table 1.

TABLE 1

| x | y |
|---|---|
| 0.3399 | 0.3646 |
| 0.3209 | 0.3356 |
| 0.3137 | 0.3246 |
| 0.3076 | 0.3178 |
| 0.3021 | 0.3143 |
| 0.2963 | 0.3096 |
| 0.2937 | 0.3047 |
| 0.2919 | 0.3003 |
| 0.2904 | 0.2970 |
| 0.2879 | 0.2921 |

The pmat for gamut 101 is (no scaling; luminances in nits):

| | | |
|---|---|---|
| 2632.821 | 7975.49 | 10603.02 |
| 2751 | 8205 | 10844 |
| 3501.838 | 11142.19 | 15064.76 |

This pmat can be used to calculate $I_p$ values as described above.

For example, to four significant figures, in gamut 101, intensities (0.2857, 0.1429, 0) produce approximately 1958 nits at (x,y)=(0.2936, 0.3040) (a neutral with CCT=8154K), or (u',v')=(0.1938, 0.4514). This point is Δxy=0.0002171 away from the closest point on a linear interpolation of the locus between each pair of adjacent points in Table 1, above. The two closest points are (0.2937, 0.3047) and (0.2919, 0.3003), and the closest point on the line between them to (0.2936, 0.3040) is (0.2934, 0.3040). Although the Δxy is small for this example, it is nonzero, demonstrating that colors that lie off the chromaticity locus of a particular EL emitter can be reproduced using that emitter, as described herein. The value of Δxy for any particular emitter and reproduced color depends on the shape of the locus and the selected color. For example, a semi-circular locus has a Δxy to a point at the center of the locus equal to the radius of the locus.

Figure 4:
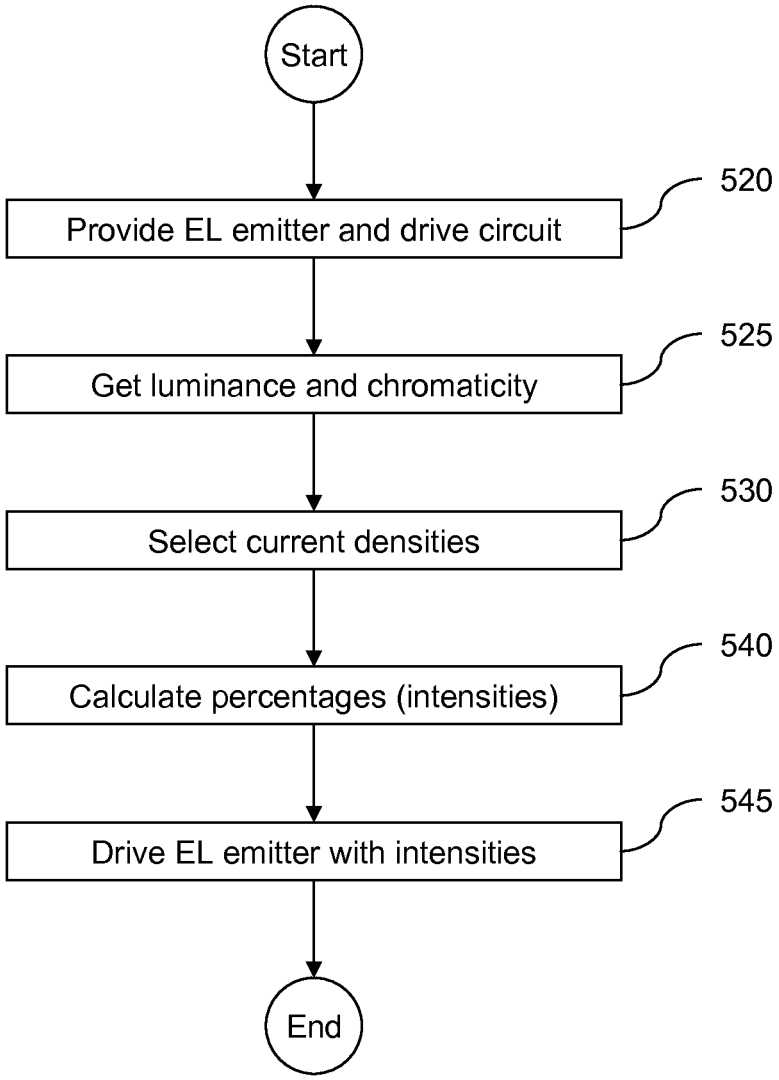
FIG. 4 is a flowchart of an embodiment of a method for compensating for chromaticity shift of an EL emitter according to various embodiments.

FIG. 4 is a flowchart of an embodiment of a method for compensating for chromaticity shift of electroluminescent (EL) emitter 50 according to various embodiments. The EL emitter 50 and drive circuit 700 are provided (step 520). The designated color, i.e. the designated luminance and chromaticity, is received (step 525), e.g., from a processor or image-processing controller integrated circuit as known in the art. The current densities are selected based on $xyY_d$ as described above (step 530). The percentages (intensities) of the primaries are calculated as described above (step 540). Finally, the EL emitter 50 is driven with the current densities at the respective intensities (on-times) (step 545).

EL devices can be implemented on a variety of device substrates with a variety of technologies. For example, EL displays can be implemented using amorphous silicon (a-Si) or low-temperature polysilicon (LTPS) on glass, plastic or steel-foil display substrates. In one embodiment, an EL device is implemented using chiplets, which are control elements distributed over a device substrate. A chiplet is a relatively small integrated circuit compared to the device substrate and includes a circuit including wires, connection pads, passive components such as resistors or capacitors, or active components such as transistors or diodes, formed on an independent chiplet substrate. Details concerning chiplets and the processes for preparing them can be found, for example, in U.S. Pat. No. 6,879,098; U.S. Pat. No. 7,557,367; U.S. Pat. No. 7,622,367; US20070032089; US20090199960 and US20100123268, the disclosures of all of which are incorporated by reference herein.

Figure 5:
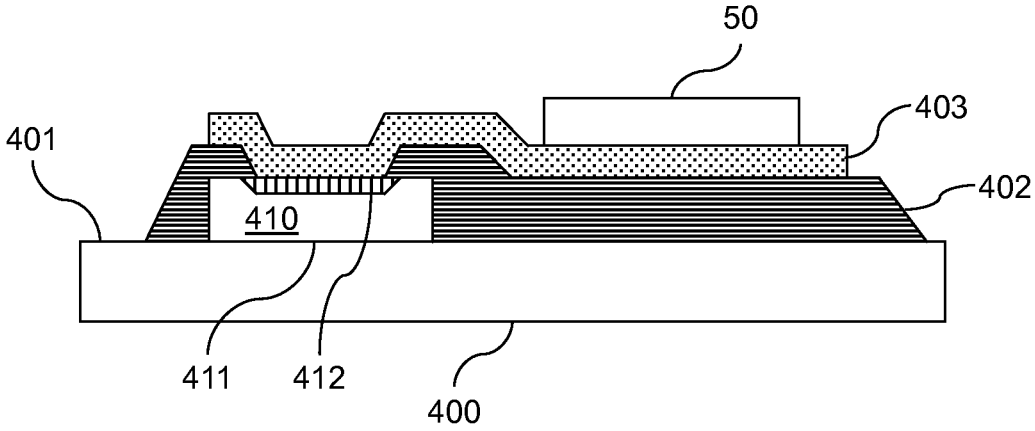
FIG. 5 is a side view of a substrate and chiplet according to an embodiment.

FIG. 5 shows a side view of one embodiment of an EL device using chiplets. Device substrate 400 can be glass, plastic, metal foil, or other substrate types known in the art. Device substrate 400 has a device side 401 over which the EL emitter 50 is disposed. When the EL device is a display, device substrate 400 is a display substrate. An integrated circuit chiplet 410 having a chiplet substrate 411 different from and independent of the device substrate 400 is located over, and affixed to, the device side 401 of the device substrate 400. Chiplet 410 can be affixed to the device substrate using e.g., a spin-coated adhesive. Chiplet 410 includes a drive circuit 700 (FIG. 6) electrically connected to EL emitter 50 for providing the current to the EL emitter 50. Chiplet 410 also includes a connection pad 412, which can be metal. Planarization layer 402 overlays chiplet 410 but has an opening or via over pad 412. Metal layer 403 makes contact with pad 412 at the via and carries current from the drive circuit 700 within chiplet 410 to EL emitter 50. One chiplet 410 can provide current to one or to multiple EL emitters 50, and can include one drive circuit 700 or multiple drive circuits 700. Each drive circuit 700 can provide current to one or to multiple EL emitters 50.

Figure 6:
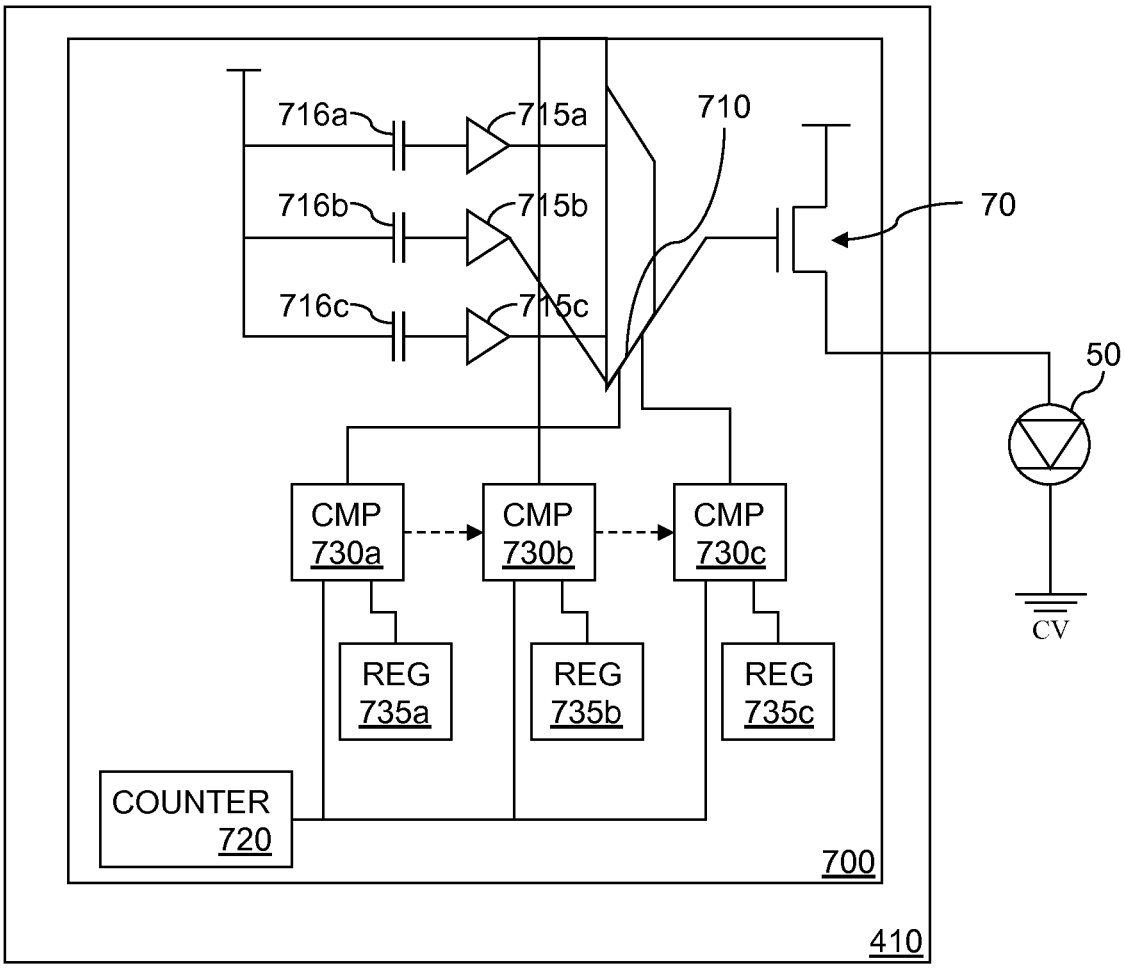
FIG. 6 is a schematic diagram of a drive circuit according to an embodiment.

FIG. 6 shows a drive circuit 700 in a chiplet 410 electrically connected to the EL emitter 50 for providing the current to the EL emitter 50 according to an embodiment. Drive circuit 700 includes drive transistor 70 for supplying the current to the EL emitter 50. The gate of drive transistor 70 is connected to multiplexer (mux) 710. Mux 710 has three inputs connected to the outputs of analog buffers 715*a*, 715*b*, and 715*c*. Each buffer's input is connected to a respective capacitor 716*a*, 716*b*, 716*c* for holding gate voltages of drive transistor 70 which correspond e.g., to the black 136, first 137 and second 138 current densities. The voltages can be stored on the capacitors by conventional sample-and-hold circuits (not shown). The selector inputs of mux 710 are connected to the outputs of comparators 730*a*, 730*b*, 730*c*. Each comparator compares the output from a running counter 720 to a trigger value or values stored in a respective register 735*a*, 735*b*, 735*c*. When the value of the counter is in the correct range for a particular current density, the corresponding comparator causes the mux to pass the corresponding gate voltage to drive transistor 70 to provide the corresponding current density to EL emitter 50.

Figure 8:
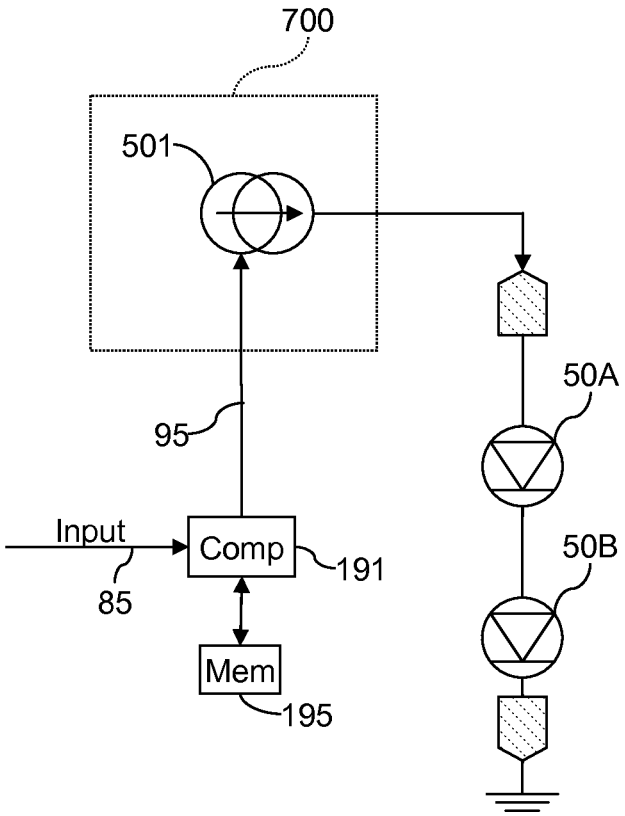
FIG. 8 is a schematic diagram of an embodiment of an EL lamp.

For example, an eight-bit counter can count 256ths of the emission period $[0, t_f)$, starting at 0, crossing over to 255 at $t_f - t_f/256$, and rolling over back to 0 at $t_f$. When the counter value is 0 to the value stored in register 735*a* minus one, comparator 730*a* can output TRUE, and the other comparators output FALSE, to cause the mux 710 to pass the value from capacitor 716*a* to the gate of drive transistor 70. From the register 735*a* value to the register 735*b* value minus one, comparator 730*b* can output TRUE and the others FALSE, and from the register 735*b* value to the register 735*c* value, comparator 730*c* can output TRUE and the others FALSE. As indicated by the dashed arrows, comparators 730*a*, 730*b* and 730*c* can communicate with each other to indicate when the next comparator should output TRUE. This is one of many possible drive circuits which can be employed with various embodiments; FIGS. 7 and 8 show two other drive circuits, and other configurations will be obvious to those skilled in the art. For example, multiple drive transistors can be used, and their outputs muxed to the EL emitter 50. In other embodiments, drive circuit 700 can be implemented using thin-film transistors (TFTs) on an LTPS or amorphous-silicon backplane.

Referring back to FIG. 5, chiplets 410 are separately manufactured from the device substrate 400 and then applied to the device substrate 400. The chiplets 410 are preferably manufactured using silicon or silicon on insulator (SOI) wafers using known processes for fabricating semiconductor devices. Each chiplet 410 is then separated prior to attachment to the device substrate 400. The crystalline base of each chiplet 410 can therefore be considered a chiplet substrate 411 separate from the device substrate 400 and over which the chiplet circuitry is disposed. The plurality of chiplets 410 therefore has a corresponding plurality of chiplet substrates 411 separate from the device substrate 400 and each other. In particular, the independent chiplet substrates 411 are separate from the device substrate 400 on which the pixels are formed and the areas of the independent, chiplet substrates 411, taken together, are smaller than the device substrate 400. Chiplets 410 can have a crystalline chiplet substrate 411 to provide higher performance active components than are found in, for example, thin-film amorphous or polycrystalline silicon devices. Chiplets 410 can have a thickness of 100 μm or less, and preferably of 20 μm or less. This facilitates formation of the planarization layer 402 over the chiplet 410 using conventional spin-coating techniques. According to an embodiment, chiplets 410 formed on crystalline silicon chiplet substrates 411 are arranged in a geometric array and adhered to a device substrate 400 with adhesion or planarization materials. Connection pads 412 on the surface of the chiplets 410 are employed to connect each chiplet 410 to signal wires, power busses and row or column electrodes to drive pixels (e.g., metal layer 403). In some embodiments, chiplets 410 control at least four EL emitters 50.

Since the chiplets 410 are formed in a semiconductor substrate, the circuitry of the chiplet 410 can be formed using modern lithography tools. With such tools, feature sizes of 0.5 microns or less are readily available. For example, modern semiconductor fabrication lines can achieve line widths of 90 nm or 45 nm and can be employed in making the chiplets 410. The chiplet 410, however, also requires connection pads 412 for making electrical connection to the metal layer 403 provided over the chiplets 410 once assembled onto the device substrate 400. The connection pads 412 are sized based on the feature size of the lithography tools used on the device substrate 400 (for example 5 μm) and the alignment of the chiplets 410 to any patterned features on the metal layer 403 (for example ±5 μm). Therefore, the connection pads 412 can be, for example, 15 μm wide with 5 μm spaces between the pads 412. The pads 412 will thus generally be significantly larger than the transistor circuitry formed in the chiplet 410.

The pads 412 can generally be formed in a metallization layer on the chiplet 410 over the transistors. It is desirable to make the chiplet 410 with as small a surface area as possible to enable a low manufacturing cost.

By employing chiplets 410 with independent chiplet substrates 411 (e.g., comprising crystalline silicon) having circuitry with higher performance than circuits formed directly on the device substrate 400 (e.g., amorphous or polycrystalline silicon), an EL device with higher performance is provided. Since crystalline silicon has not only higher performance but also much smaller active elements (e.g., transistors), the circuitry size is much reduced. A useful chiplet 410 can also be formed using micro-electro-mechanical (MEMS) structures, for example as described in "A novel use of MEMs switches in driving AMOLED", by Yoon, Lee, Yang, and Jang, Digest of Technical Papers of the Society for Information Display, 2008, 3.4, p. 13.

The device substrate 400 can include glass and the metal layer or layers 403 can be made of evaporated or sputtered metal or metal alloys, e.g., aluminum or silver, formed over a planarization layer 402 (e.g., resin) patterned with photolithographic techniques known in the art. The chiplets 410 can be formed using conventional techniques well established in the integrated circuit industry.

Electroluminescent (EL) devices include EL displays and EL lamps. The present invention is applicable to both, and will be discussed first with reference to an EL display.

FIG. 7 shows a schematic diagram of one embodiment of an EL subpixel and associated circuitry useful with various embodiments on an EL display 10 (FIG. 9). In FIG. 9, EL subpixel 60 includes EL emitter 50, drive transistor 70, capacitor 75 and select transistor 90. Moving to FIG. 7, drive transistor 70 is part of drive circuit 700 electrically connected to the EL emitter 50 for providing the current to the EL emitter 50. Each of the transistors has a first electrode, a second electrode, and a gate electrode. A first voltage source 140 is connected to the first electrode of drive transistor 70. By connected, it is meant that the elements are directly connected or connected via another component, e.g., a switch, a diode, or another transistor. The second electrode of drive transistor 70 is connected to a first electrode of EL emitter 50, and a second voltage source 150 is connected to a second electrode of EL emitter 50. Select transistor 90 connects data line 35 to the gate electrode of drive transistor 70 to selectively provide data from data line 35 to drive transistor 70 as well-known in the art. Each row select line 20 is connected to the gate electrodes of the select transistors 90 in the corresponding row of EL subpixels 60.

A compensator 191 receives the designated luminance and selected chromaticity on input line 85. Compensator 191 selects the current densities of the primaries using the designated luminance and selected chromaticity and calculates the percentages $I_p$ using the designated luminance and chromaticity and the selected current densities. It then provides information corresponding to the selected current densities and the calculated percentages on control line 95. Source driver 155 receives the information and produces a drive transistor control waveform on data line 35. The drive transistor control waveform includes the gate voltages necessary to cause the drive transistor to produce a current-density waveform such as those illustrated in FIGS. 3A and 3B. Compensator 191 can be a CPU, FPGA or ASIC, PLD, or PAL.

In one embodiment, the drive transistor control waveform includes a first gate voltage, a second gate voltage, and a black gate voltage in sequence for the percentages of the emission time corresponding to the black, first and second primaries. Thus, compensator 191 can provide compensated data during the display process. As known in the art, the designated luminance and chromaticity can be provided by a timing controller (not shown). The designated luminance and chromaticity can correspond to an input code value. The input code value can be digital or analog, and can be linear or nonlinear with respect to commanded luminance. If analog, the input code value can be a voltage, a current, or a pulse-width modulated waveform. Compensator 191 can optionally be connected to memory 195 for storing information used in selecting the primaries, such as the primaries themselves, if pre-selected primaries are used for designated luminances at the selected chromaticity, or tables mapping selected chromaticities and designated luminances or luminance ranges to primaries. Memory 195 can be non-volatile storage such as Flash or EEPROM, or volatile storage such as SRAM.

Source driver 155 can include a digital-to-analog converter or programmable voltage source, a programmable current source, or a pulse-width modulated voltage ("digital drive") or current driver, or another type of source driver known in the art, provided that it can cause the a current-density waveform, e.g., FIGS. 3A and 3B, to be applied to EL emitter 50. In this embodiment, drive circuit 700 includes source driver 155, select transistor 90, drive transistor 70 and the connections between those three parts and corresponding control lines.

In one embodiment, before mass-production of the EL device, one or more representative devices can be characterized to produce an product model mapping the designated luminance and the selected chromaticity to the corresponding selected black 136, first 137, second 138, and optionally third 139 current densities. More than one product model can be created. For example, different regions of the device can have different product models. The product model can be stored in a lookup table or used as an algorithm. These models can be combined, or the boundaries between them smoothed, by regression techniques known in the statistical art such as spline fitting. Compensator 191 can store the product model (s), e.g., in memory 195.

FIG. 8 shows an alternative embodiment useful in an EL lamp. EL emitters 50A and 50B are arranged in series and are supplied current by current source 501. Drive circuit 700 includes current source 501 electrically connected to each EL emitter 50A, 50B for providing to the EL emitter current corresponding to a signal on control line 95. The compensation described above is performed, except that the compensated code value from compensator 191 represents a current rather than a voltage. This embodiment can also apply to a single EL emitter. The EL emitters 50A, 50B can also be driven by a constant voltage rather than a constant current. Compensator 191, memory 195, input line 85, and control line 95 are as described above on FIG. 7.

In a preferred embodiment, the EL device includes Organic Light Emitting Diodes (OLEDs) which are composed of small molecule or polymeric OLEDs as disclosed in but not limited to U.S. Pat. No. 4,769,292 and U.S. Pat. No. 5,061,569. Many combinations and variations of organic light emitting materials can be used to fabricate such a device. Referring to FIG. 7, when EL emitter 50 is an OLED emitter, EL subpixel 60 is an OLED subpixel. Inorganic EL devices can also be employed, for example quantum dots formed in a polycrystalline semiconductor matrix (for example, as taught in US 2007/0057263, the disclosure of which is incorporated herein by reference), devices employing organic or inorganic charge-control layers or hybrid organic/inorganic devices.

Transistors 70, 80 and 90 can be amorphous silicon (a-Si) transistors, low-temperature polysilicon (LTPS) transistors, zinc oxide transistors, or other transistor types known in the art. They can be N-channel, P-channel, or any combination. The OLED can be a non-inverted structure (as shown) or an inverted structure in which EL emitter 50 is connected between first voltage source 140 and drive transistor 70.

The invention has been described in detail with particular reference to certain preferred embodiments thereof, but it will be understood that combinations of embodiments, variations, and modifications can be effected within the spirit and scope of the invention.

PARTS LIST

10 EL display
15 pixel
20 select line
35 data line
50, 50A, 50B EL emitter
60 EL subpixel
70 drive transistor
75 capacitor
85 input line
90 select transistor
95 control line
100 curve
101 gamut
102 black chromaticity
103 first chromaticity
104 second chromaticity
105 third chromaticity
108 line
112 luminance range
125 point
129 threshold of visibility
130 curve
132 black luminance
133 first luminance
134 second luminance
135 third luminance
136 black current density
137 first current density
138 second current density
139 third current density
140 first voltage source
150 second voltage source
155 source driver
191 compensator
195 memory
301, 302, 303, 304, 305, 306 time
308 emission time
310 waveform
320 waveform
330 waveform
400 device substrate
401 device side

402 planarization layer
403 metal layer
410 chiplet
411 chiplet substrate
412 pad
501 current source
520 step
525 step
530 step
540 step
545 step
700 drive circuit
710 multiplexer (mux)
715*a*, 715*b*, 715*c* buffer
716*a*, 716*b*, 716*c* capacitor
720 counter
730*a*, 730*b*, 730*c* comparator
735*a*, 735*b*, 735*c* register

What is claimed is:

1. A method for compensating for chromaticity shift of an organic light-emitting diode (OLED) emitter, comprising:

a) providing the OLED emitter for receiving current and emitting light having a luminance and a chromaticity that both correspond to the density of the current;

b) providing a drive circuit electrically connected to the OLED emitter for providing the current to the OLED emitter;

c) receiving a designated luminance and selecting a chromaticity for the OLED emitter;

d) selecting different black, first and second current densities based on the designated luminance and selected chromaticity, wherein i) at the selected black, first and second current densities the emitted light has respective, black, first and second luminances and respective, black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

e) calculating respective black, first and second percentages of a selected emission time using the designated luminance, the selected chromaticity, and the black, first and second luminances and chromaticities, wherein the sum of the black, first and second percentages is less than or equal to 100%; and f) providing the black, first and second percentages to the drive circuit to cause it to provide the black, first and second current densities to the OLED emitter for the black, first and second percentages, respectively, of the selected emission time, so that the integrated light output of the OLED emitter during the selected emission time has an output luminance and output chromaticity colorimetrically indistinct from the designated luminance and selected chromaticity, respectively, whereby the chromaticity shift of the OLED emitter is compensated.

2. The method of claim 1, wherein the drive circuit provides only the black, first and second current densities.

3. The method of claim 1, wherein the OLED emitter is a broadband emitter.

4. The method of claim 1, wherein the black current density is less than 0.02 mA/cm$^2$.

5. The method of claim 1, wherein step d further includes providing a lookup table mapping the designated luminance and selected chromaticity to the selected black, first and second current densities.

6. The method of claim 1, wherein the sum of the black, first and second percentages equals 100%.

7. The method of claim 6, wherein the drive circuit provides each of the black, first and second current densities for respective uninterrupted periods of time.

8. The method of claim 1, wherein the sum of the black, first and second percentages is less than 100%, and the drive circuit provides current ramps between consecutive current densities to the OLED emitter.

9. The method of claim 8, wherein the current ramps are sinusoidal.

10. A method for compensating for chromaticity shift of an organic light-emitting diode (OLED) emitter, comprising:

a) providing the OLED emitter for receiving current and emitting light having a luminance and a chromaticity that both correspond to the density of the current;

b) providing a drive circuit electrically connected to the OLED emitter for providing the current to the OLED emitter;

c) receiving a designated luminance and selecting a chromaticity for the OLED emitter;

d) selecting different black, first, second and third current densities based on the designated luminance and selected chromaticity, wherein i) at the selected black, first, second and third current densities the emitted light has respective, black, first, second and third luminances and respective, black, first, second and third chromaticities;

ii) the respective luminance of each of the black, first, second and third current densities is colorimetrically distinct from the other three luminances, or the respective chromaticity of each of the black, first, second and third current densities is colorimetrically distinct from the other three chromaticities; and iii) the black luminance is less than a selected threshold of visibility, and the first, second and third luminances are greater than or equal to the selected threshold of visibility;

e) calculating respective black, first, second and third percentages of a selected emission time using the designated luminance, the selected chromaticity, and the black, first, second and third luminances and chromaticities, wherein the sum of the black, first, second and third percentages is less than or equal to 100%; and f) providing the black, first, second and third percentages to the drive circuit to cause it to provide the black, first, second and third current densities to the OLED emitter for the black, first, second and third percentages, respectively, of the selected emission time, so that the integrated light output of the OLED emitter during the selected emission time has an output luminance and output chromaticity colorimetrically indistinct from the designated luminance and selected chromaticity, respectively, whereby the chromaticity shift of the OLED emitter is compensated.

11. The method of claim 10, wherein the sum of the black, first, second and third percentages equals 100%.

12. The method of claim 11, wherein the drive circuit provides each of the black, first, second and third current densities for respective uninterrupted periods of time.

13. The method of claim 11, wherein the drive circuit provides only the black, first, second and third current densities.

14. The method of claim 1, wherein the selected chromaticity is producible as a combination of the first and second luminances and the first luminance is smaller than the second luminance, further including repeatedly receiving a designated luminance, selecting the different black, first, and second current densities based on the received designated luminance and on the selected chromaticity, calculating the black, first, and second percentages, and providing the black, first, and second percentages.

15. The method of claim 1, further including determining whether the designated luminance is producible by the OLED emitter using the selected black, first, and second current densities, and:

if so, performing the selecting, calculating, and providing steps; and if not, selecting a third current density at which the designated luminance is producible by the OLED emitter, calculating a third percentage of the selected emission time using the designated luminance, and providing the third percentage to the drive circuit to cause it to provide the third current density to the OLED emitter for the third percentage of the selected emission time, so that the integrated light output of the OLED emitter during the selected emission time has an output luminance colorimetrically indistinct from the designated luminance.

16. The method of claim 10, further including determining whether the designated luminance is producible by the OLED emitter using the selected black, first, second, and third current densities, and:

if so, performing the selecting, calculating, and providing steps; and if not, selecting a fourth current density at which the designated luminance is producible by the OLED emitter, calculating a fourth percentage of the selected emission time using the designated luminance, and providing the fourth percentage to the drive circuit to cause it to provide the fourth current density to the OLED emitter for the fourth percentage of the selected emission time, so that the integrated light output of the OLED emitter during the selected emission time has an output luminance colorimetrically indistinct from the designated luminance.

* * * * *